United States Patent [19]

Kern

[11] Patent Number: 4,651,379

[45] **Date of Patent: * Mar. 24, 1987**

[54] ROLLER TRAY WITH COVER

[76] Inventor: Gilbert G. Kern, 515 N. Victory Blvd., Burbank, Calif. 91502

[ * ] Notice: The portion of the term of this patent subsequent to Oct. 22, 2002 has been disclaimed.

[21] Appl. No.: 788,395

[22] Filed: Oct. 17, 1985

Related U.S. Application Data

[63] Continuation-in-part of Ser. No. 558,374, Dec. 5, 1983, Pat. No. 4,547,926.

[51] Int. Cl.[4] ..... B44D 3/12

[52] U.S. Cl. ..... 15/257.06; 220/4 B

[58] Field of Search ..... 15/257.06, 257.05; 220/4 B, 4 E, 85 CH, 23, 335; 206/1.7; 134/6; 118/258, 263

[56] References Cited

U.S. PATENT DOCUMENTS

| | | | |
|---|---|---|---|
| 643,855 | 2/1900 | Williamson | 15/257.05 |
| 2,114,891 | 4/1938 | Vaughn | 15/257.05 |
| 2,490,546 | 12/1949 | Rubin | 15/257.06 |
| 2,659,917 | 11/1953 | Drum | 15/257.06 |
| 3,152,716 | 10/1964 | Feldhahn | 220/4 E |
| 3,266,655 | 8/1966 | Trunk | 220/4 E |
| 3,351,970 | 11/1967 | Engh | 15/257.06 |
| 3,850,298 | 11/1974 | Jolly | 15/257.06 |
| 4,010,866 | 3/1977 | McClane | 15/257.06 X |
| 4,200,949 | 5/1980 | Heniff, Jr. | 15/257.06 |
| 4,445,250 | 5/1984 | Seidl | 15/257.06 |

FOREIGN PATENT DOCUMENTS

| | | | |
|---|---|---|---|
| 559080 | 6/1958 | Canada | 15/257.06 |
| 2411772 | 8/1979 | France | 220/4 E |

*Primary Examiner*—Edward L. Roberts
*Attorney, Agent, or Firm*—Bernard P. Drachlis

[57] ABSTRACT

Paint roller tray has generally rectangular closed bottom and sides which terminate in upper periphery. Hinged cover seals against the periphery of the sides to exclude air to inhibit drying of the paint. Preferably, the cover has retainers on the inside for holding paint rollers and/or brushes so that those painting implements also do not dry out. An interior sloped roller plate provides a roller operating area, without reducing interior volume.

11 Claims, 3 Drawing Figures

ROLLER TRAY WITH COVER

CROSS REFERENCE

This application is a continuation-in-part of my earlier application Ser. No. 558,374, filed Dec. 5, 1983, now U.S. Pat. No. 4,547,926, Oct. 22, 1985, the entire disclosure of which is incorporated by this reference.

BACKGROUND

This invention is directed to a roller tray with hinged cover wherein the cover can swing to the closed position to seal on the tray to maintain material in the tray in fresh condition and wherein the tray is a full rectangular receptacle for maximum paint volume.

Paint roller trays are well-known. Such trays have sides and bottoms, with a reservoir in a portion of the bottom and a further portion of the bottom being sloped so that a paint roller can be dipped in the paint in the reservoir and rolled out on the sloped bottom. Rollers for such purposes are also well-known. In addition, conventional paint brushes are sometimes used with such a paint roller tray, with the brushes usually used for edging and filling deeper cracks and holes. Such a paint tray may also be used with other paint applying devices such as paint pads.

These conventional paint roller trays and associated implements are used by pouring paint in the tray and employing the various implements to remove the paint from the tray and apply it to the surface being painted. The reduced volume provided by the sloped bottom produces delays and intertupted production. Quite often the job is interrupted before the painting is completed. Even a lunch break causes stiffening of most paints to the point where the paint roller tray and the painting implements must be cleaned. Such is definitely true for any paint on an overnight break in the painting operation. The cleaning of the paint roller tray and the painting implements is both time-consuming and wasteful of paint. A considerable amount of time is necessary to properly return the paint from the paint roller tray back into the paint can, and, thereupon, clean the remaining paint from the paint roller tray. Some residual paint can usually be recovered from a roller and returned to the paint can, but little paint can be recovered from a painting pad or a paint brush. Therefore, that which remains must be washed out. Furthermore, there is the cost of the solvent employed in the cleaning. Thus, there is a need for a roller tray which will preserve solvent-containing material therein over a short time to avoid the need for cleaning the tray from one shift to the next.

SUMMARY OF THE INVENTION

In order to aid in the understanding of this invention, it can be stated in essentially summary form that it is directed to a roller tray with cover wherein the tray has a substantially flat bottom and contiguous sides which terminate in an upper periphery. An inserted roller plate provides for rolling onto the roller. A hingedly mounted cover swings down against this periphery to enclose and seal the tray to maintain solvent-containing material therein and material applying implements therein away from conditions which would dry out the material.

It is, thus, an object of this invention to provide a roller tray having a hinged cover thereon for protecting material in the tray against drying out so that the cover may be hinged open for a painting shift and may be hinged closed on the tray between shifts to avoid drying out of the material in the tray and avoid cleaning of the tray between shifts.

It is another object and advantage of this invention to provide a roller tray with an increased volume by providing a rectangular tray bottom for maximum volume and an inserted roller plate for rolling the paint smoothly into the roller, sometimes called rolling-out the roller.

It is a further object and advantage of this invention to provide a roller tray and hinged cover which is particularly useful with paint and paint applying implements and similar materials and implements.

Other objects and advantages of this invention will become apparent from a study of the following portion of the specification, the claims and the attached drawings.

DESCRIPTION OF THE PREFERRED EMBODIMENT

Figure 1:
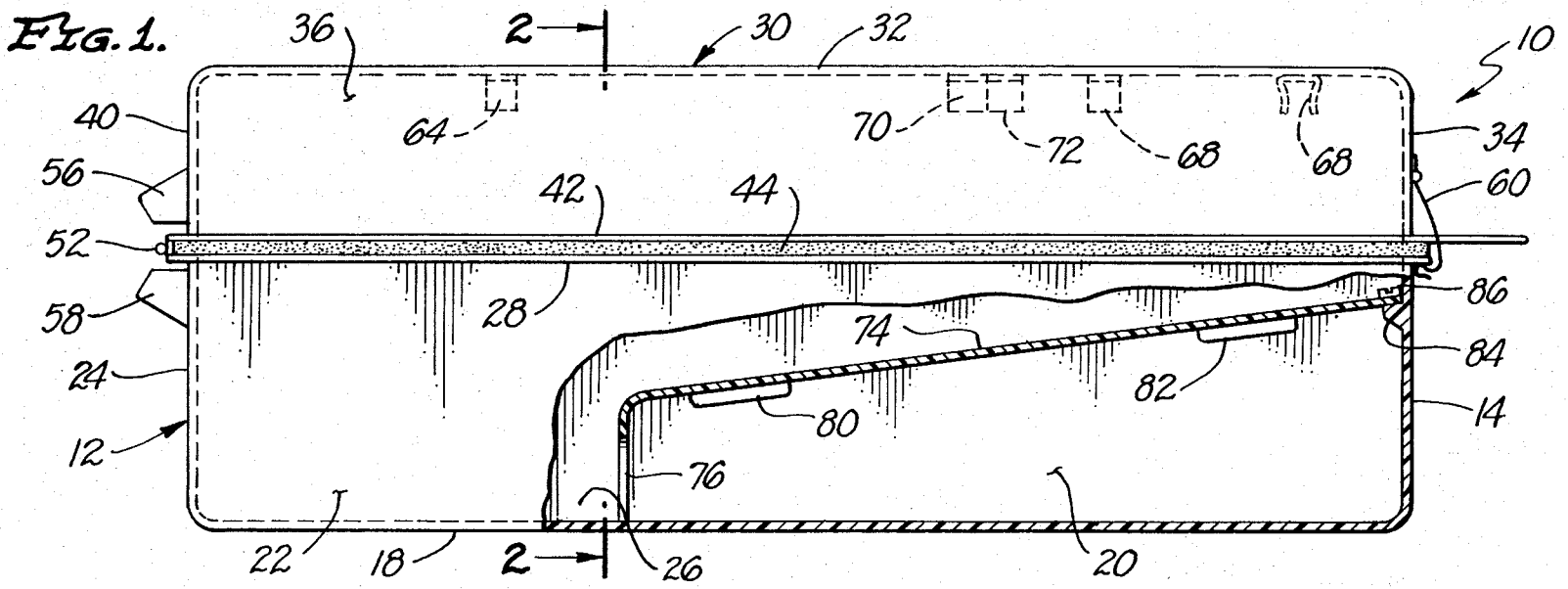
FIG. 1 is a side-elevational view of the roller tray with cover in accordance with this invention, with parts broken away to show the interior roller plate.
Figure 3:
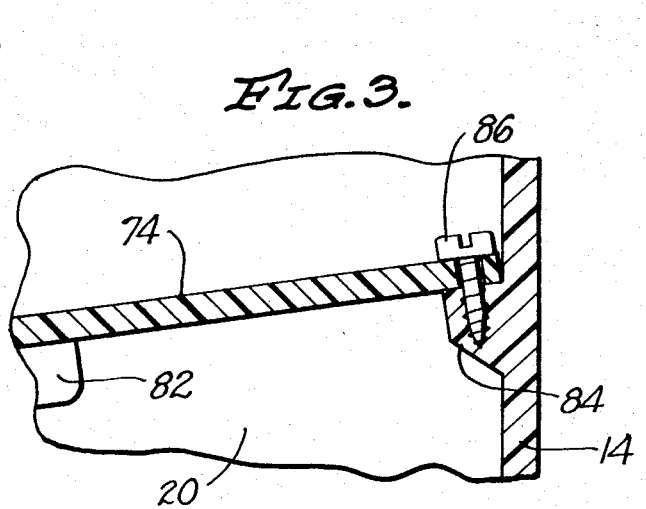
FIG. 3 is an enlarged detail of the attachment of the roller plate to the front side of the roller tray.
Figure 2:
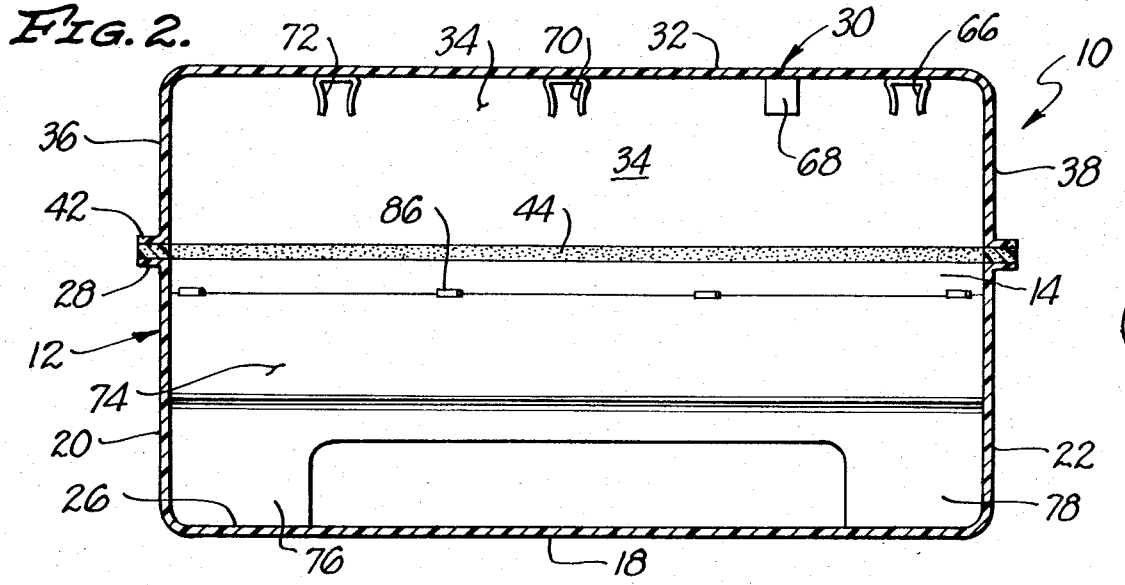
FIG. 2 is a sectional view of the roller tray with cover as seen along the line 2—2 of FIG. 1.

The roller tray assembly with its hinged cover in accordance with this invention is generally indicated at 10 in FIGS. 1 and 2. The roller tray is generally indicated 12 in the same FIGURES. The roller tray with its hinged cover is particularly described for use with paint, for it is expected it will see its greatest use with paint. However, it is clear that it is equally useful with other solvent-containing material, such as some adhesives and cements. Paint roller tray 12 has a flat bottom 18 extending between the ends and sides of the tray 12. Left and right sides 20 and 22 and front and back sides 14 and 24 join bottom 18 to define a well 26 in which paint can be stored for use. The full volume of the rectangular bottom is thus available for paint. When a roller is dipped into the paint, it is desirable to roll-out or even-out the paint in the roller. This is done by rolling it against a sloping roller plate. Roller plate 74 is obtusely "el" shaped, as seen in FIG. 1. It has feet 76 and 78, see FIG. 2, which permit paint under the roller plate to flow out into the left end open part of well 26. Roller plate 74 rests on stops 80 and 82 molded into the right side wall 20. Similar stops are molded into the left, near side wall 22 in FIG. 1. Similar stops are molded into the front end wall 14. Stop 84 is seen in FIG. 1 and is seen enlarged in FIG. 3. Screw 86 through roller plate 74 into stop 86 may be used to hold the roller plate in place. A paint roller can be dipped into paint in the well 26 and rolled out on the top side of the sloping roller plate 74. The sides of paint roller tray 12 terminate at an upper peripheral flange 28. Flange 28 has a planar top surface, as is seen in FIG. 3.

Cover 30, seen in FIGS. 1 and 2, has a top 32 and four side walls. As seen in FIG. 2, there is front side wall 34, right and left side walls 36 and 38, and back side wall 40. The side walls are formed contiguously with top 32 to form an enclosed cover. The side walls extend downward to top flange 42, which is planar and lies parallel to and faces peripheral flange 28. Seal ring 44 is a soft seal, preferably made of elastomeric, resilient tubing or a closed cell elastomeric foam material having a continuous skin thereon. The seal ring 44 is adhesively attached to top flange 42. Thus, all sealing between flanges 28 and 42 is by means of the seal ring 44.

The paint roller tray 12 and the cover 30 are preferably each integrally molded of suitable synthetic polymer composition material of such nature as to be resistant to the paint which will be used in the paint roller tray with cover 10. Each is fully closed, except for the open faces which face each other, and are sealed together by seal ring 44. Seal ring 44 is also suitably resistant to the paint material.

A pair of hinges, one of which is indicated at 52, is secured to the top and bottom. Stops 56 and 58 are molded onto cover 30 and tray 12 to limit the opening of the cover 30. When open, seal ring 44 rises with tthe cover to minimize its contact with the paint to thereby minimize cleaning of the seal ring. As previously discussed, when painting is complete, the cover is hinged down into the closed position on top of tray 12. The hinges are positioned so that when the cover swings closed, the sealing ring is compressed. The hinges act as a vise to compress the seal ring. The cover is retained in the closed position by spring latches, one of which is seen at 60, which are hinged on the cover and resiliently engage beneath peripheral flange 28 to compress seal ring 44 to maintain the closed seal around the paint roller tray with respect to its cover 30.

A plurality of clips 64, 66, 68, 70 and 72 are secured underneath the cover. The configuration of the clips may vary to accommodate different devices. The clips 64 and 70 are configured and positioned for the retaining of a conventional paint roller within cover 30 up against top 32. Similarly, clip 72 is configured and positioned for retaining a paint brush. Various other clips may be positioned and sized for other brushes, paint rollers or painting pad implements. The clips may be riveted in place or other attachment means can be used.

In use, cover 30 is hinged to the raised position and paint or other solvent-containing material is poured into well 26 which occupies the entire bottom area of tray 12. A roller, brush and/or a paint pad or other painting implement may be dipped into the paint in the well 26. The implement may be brushed off against sloping roller plate 74, and the paint remaining on the implement can be applied to the surface being painted. As the paint is used by dipping the roller or brush into the left end of well 26, as seen in FIG. 1, the paint flows out from under the roller plate between feet 76 and 78 to maintain adequate paint level through longer usage. The complete lower volume of the rectangular tray is available as a paint reservoir.

When the painting shift is done, the painting implements are attached, without cleaning, to the clips fastened to the underside of the top of the cover. Thereupon the cover is hinged closed and latched to completely seal off the interior space defined within the paint roller tray and cover. Seal ring 44 seals the joints between the tray and the cover, and there are no other openings. In this condition, the solvent in the paint soon saturates the entire volume and the paint cannot dry out further. Therefore, the paint remaining in the painting implements does not stiffen and the paint in well 26 does not dry out. When the cover is closed over the paint roller tray for a lunch break, for an overnight, or for a weekend, the remaining paint and the paint saturated painting implements remain fresh and ready for immediate use. Thus, the time for cleanup is saved, the solvent which would have been used in cleanup is saved, and the paint which would have been lost in cleanup is saved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A roller tray with cover;

said roller tray having sides and having a flat bottom extending between said sides to form an upwardly open but otherwise closed rectangular container having an upper upwardly directed peripheral surface;

said cover having a top and having downwardly directed side walls having a downwardly direction surface so that said cover is closed except for its downwardly facing opening between said side walls, said side walls being positioned so that its downwardly directed surface faces the upwardly directed peripheral surface of said sides of said tray, said cover being hingedly mounted on said tray, clips secured within said cover, said clips being configured to releaseably retain implements within said cover;

a resilient seal between said surfaces on said tray and on cover so that said cover can be hingedly raised with respect to said tray to selectively provide access to said tray and selectively hinged down to cover, enclose and seal said tray to inhibit drying of material within said tray; and a roller plate secured within said roller tray in a position above said bottom and at an acute angle with respect to said bottom, at least a portion of said angular roller plate which is closest to said bottom being spaced above said bottom to provide communication out of the space below said roller plate to provide material storage beneath said roller plate.

2. The roller tray with cover of claim 1 wherein said tray has an upwardly facing peripheral flange at the top of its sides and said upwardly directed surface is on said flange, said seal engaging against said peripheral flange.

3. The roller tray with cover of claim 1 wherein said side walls of said top terminate at their lower edges at a top flange with said downwardly directed surface on said top flange and said seal engages between said top flange and said peripheral flange.

4. The roller tray with cover of claim 1 wherein said seal is retained by adhesive attachment.

5. The roller tray with cover of claim 4 wherein said roller tray and said cover are each molded as one piece of synthetic polymer composition material.

6. A roller tray with cover;

said roller tray having sides and having a substantially flat bottom extending between said sides to form a rectangular upwardly open but otherwise closed container having an upper upwardly directed peripheral surface, said roller tray being molded as one piece of synthetic polymer composition material;

a roller plate positioned within said tray, said roller plate lying at an acute angle with respect to said bottom and lying spaced from said bottom to permit paint storage below said roller plate;

said cover having a flat top and having downwardly directed side walls having a downwardly directed surface so that said cover is closed except for its downwardly facing opening between said side walls, said side walls being positioned so that its downwardly directed surface faces the upwardly directed peripheral surface of said sides of said tray, said cover being molded as one piece of synthetic polymer composition material, said cover being hingedly mounted on said tray, a stop molded into at least one of said roller tray and cover to limit the angular hinge opening of said cover with respect to said roller tray; and a resilient seal between said surfaces on said tray and on said cover so that said flat-topped cover can be hingedly raised with respect to said tray to selectively provide access to said tray and selectively hinged down to cover, enclose and seal said tray to inhibit drying of material within said tray.

7. A roller tray with cover;

said roller tray having a bottom and having sides to form an upwardly open but otherwise closed container having an upper upwardly directed peripheral surface, said roller tray being molded as one piece of synthetic polymer composition material;

a roller plate positioned within said tray, said roller plate lying at an acute angle with respect to said bottom and lying spaced from said bottom to permit paint storage below said roller plate;

said cover having a flat top and having downwardly directed side walls having a downwardly directed surface so that said cover is closed except for its downwardly facing opening between said side walls, said side walls being positioned so that its downwardly directed surface faces the upwardly directed peripheral surface of said sides of said tray, said cover being molded as one piece of synthetic polymer composition material, said cover being hingedly mounted on said tray a stop molded into at least one of said roller tray and cover to limit the angular hinge opening of said cover with respect to said roller tray;

a resilient seal between said surfaces on said tray and on said cover so that said flat-topped cover can be hingedly raised with respect to said tray to selectively provide access to said tray and selectively hinged down to cover, enclose and seal said tray to inhibit drying of material within said tray; and a latch interengaged between said cover and said roller tray in a position away from said hinge to releaseably retain said cover on said roller tray in a sealed position thereon.

8. A roller tray with cover;

said roller tray having a sloped bottom and having sides to form an upwardly open but otherwise closed container having an upper upwardly directed peripheral surface, said roller tray being molded as one piece of synthetic polymer composition material;

a roller plate positioned within said tray, said roller plate lying at an acute angle with respect to said bottom and lying spaced from said bottom to permit paint storage below said roller plate;

said cover having a flat top and having downwardly directed side walls having a downwardly directed surface so that said cover is closed except for its downwardly facing opening between said side walls, said side walls being positioned so that its downwardly directed surface faces the upper upwardly directed peripheral surface of said sides of said tray, said cover being hingedly mounted on said tray, said cover being molded as one piece of synthetic polymer compositon material;

a stop molded into at least one of said roller tray and cover to limit the angular hinge opening of said cover with respect to said roller tray; and a resilient seal between said surfaces on said tray and on said cover so that said cover can be hingedly raised with respect to said tray to selectively provide access to said tray and selectively hinged down to cover, enclose and seal said tray to inhibit drying of material within said tray.

9. The roller tray with cover of claim 8 wherein a latch is interengaged between said cover and said roller tray in a position away from said hinge to releaseably retain said cover on said roller tray in a sealed position thereon.

10. A roller tray with cover;

said roller tray having a bottom and having sides to form an upwardly open but otherwise closed container having an upper upwardly directed peripheral surface, said roller tray being molded as one piece of synthetic polymer composition material;

a roller plate positioned within said tray, said roller plate lying at an acute angle with respect to said bottom and lying spaced from said bottom to permit paint storage below said roller plate;

said cover having a flat top and having downwardly directed side walls having a downwardly directed surface so that said cover is closed except for its downwardly facing opening between said side walls, said side walls being positioned so that its downwardly directed surface faces the upper upwardly directed peripheral surface of said sides of said tray, said cover being hingedly mounted on said tray, said cover being molded as one piece of synthetic polymer compositon material, clips secured within said cover, said clips being configured to releaseably retain implements within said cover;

a stop molded into at least one of said roller tray and cover to limit the angular hinge opening of said cover with respect to said roller tray;

a resilient seal between said surfaces on said tray and on said cover so that said cover can be hingedly raised with respect to said tray to selectively provide access to said tray and selectively hinged down to cover, enclose and seal said tray to inhibit drying of material within said tray; and a latch interengaged between said cover and said tray in a position away from said hinge to releaseably retain said cover on said roller tray in a sealed position thereon.

11. A roller tray with cover;

said roller tray comprising a one-piece molded tray having side walls and a flat bottom extending therebetween to define a well therein, said side walls and said bottom defining an open top and otherwise closed roller tray, a peripheral flange at the top of said sides of said roller tray, the top of said peripheral flange defining a sealing surface;

a roller plate positioned within said tray, said roller plate lying at an acute angle with respect to said bottom and lying spaced from said bottom to permit paint storage below said roller plate;

a cover molded in one piece and having a substantially flat top and integral side walls, said side walls terminating in a top flange facing said peripheral flange on said roller tray;

a resilient seal between said surfaces so that said cover can be sealed with respect to said roller tray;

hinges attached to one side of said roller tray and to the adjacent side wall of said cover, said hinges being positioned so that when said cover is moved into closed position over said roller tray, said cover compresses said seal;

a stop molded on at least one of said roller tray and said cover, said stop limiting opening hinge movement of said cover with respect to said roller tray; and a releaseable latch positioned away from said hinges to releaseably hold said cover in sealed position with respect to said roller tray.

* * * * *